US008347938B2

(12) United States Patent
Schaumberger et al.

(10) Patent No.: US 8,347,938 B2
(45) Date of Patent: Jan. 8, 2013

(54) MULTIPLE-PANE WINDOW WITH AN ELECTRICAL BUILT-IN ELEMENT

(75) Inventors: Franz Schaumberger, Aschach (AT); Wolfgang Dirisamer, Linz (AT)

(73) Assignee: Saint-Gobain Glass France, Courbevoie (FR)

( * ) Notice: Subject to any disclaimer, the term of this patent is extended or adjusted under 35 U.S.C. 154(b) by 1032 days.

(21) Appl. No.: 11/569,115

(22) PCT Filed: Apr. 15, 2006

(86) PCT No.: PCT/EP2006/003485
§ 371 (c)(1),
(2), (4) Date: Nov. 14, 2006

(87) PCT Pub. No.: WO2006/114211
PCT Pub. Date: Nov. 2, 2006

(65) Prior Publication Data

US 2007/0267150 A1 Nov. 22, 2007

(30) Foreign Application Priority Data

Apr. 26, 2005 (DE) ..... 10 2005 019 326

(51) Int. Cl.
*E04B 9/32* (2006.01)

(52) U.S. Cl. ..... 160/176.1 P; 52/204.5; 160/84.02; 160/168.1 P; 160/DIG. 17

(58) Field of Classification Search ..... 52/204.5; 160/168.1 P, 176.1 P, DIG. 17, 173 R, 177 R, 160/178.1 R, 84.02, 107
See application file for complete search history.

(56) References Cited

U.S. PATENT DOCUMENTS

| | | | | |
|---|---|---|---|---|
| 4,664,169 | A * | 5/1987 | Osaka et al. | 160/107 |
| 5,603,371 | A * | 2/1997 | Gregg | 160/176.1 P |
| 5,760,558 | A * | 6/1998 | Popat | 318/480 |
| 6,332,491 | B1 * | 12/2001 | Rossini | 160/107 |
| 2004/0160388 | A1 * | 8/2004 | O'Keeffe | 345/30 |

FOREIGN PATENT DOCUMENTS

| | | |
|---|---|---|
| DE | 197 09 546 | 9/1998 |
| DE | 103 17 914 | 1/2004 |
| EP | 0 345 007 | 12/1989 |
| EP | 0 668 431 | 8/1995 |
| JP | 9-287369 | 11/1997 |
| JP | 11-16014 | 1/1999 |
| JP | 2001-40961 | 2/2001 |
| JP | 2003-221989 | 8/2003 |

OTHER PUBLICATIONS

Office Action issued Aug. 23, 2011 in Japanese Patent Application No. 2008-508113 (English translation only).

* cited by examiner

*Primary Examiner* — William Gilbert
(74) *Attorney, Agent, or Firm* — Oblon, Spivak, McClelland, Maier & Neustadt, L.L.P.

(57) ABSTRACT

According to the invention, a multilayer or insulating window pane (1) having at least two rigid panes (1P) and a spacer frame (1S) which connects these panes so as to form a tightly sealed intermediate space between the panes, and also an electrical component (3; for example motor, valve) which is arranged in the intermediate space between the panes, and also an associated electrical connection device is equipped with a detection device (4) for operating data of the component (3), which detection device cannot be manipulated from the outside but can be at least indirectly read off or read out. As a result, switch-on processes or times, maximum current consumption or operating temperature or the like, for example, can be detected and checked for servicing and/or monitoring purposes by reading out the operating data.

20 Claims, 1 Drawing Sheet

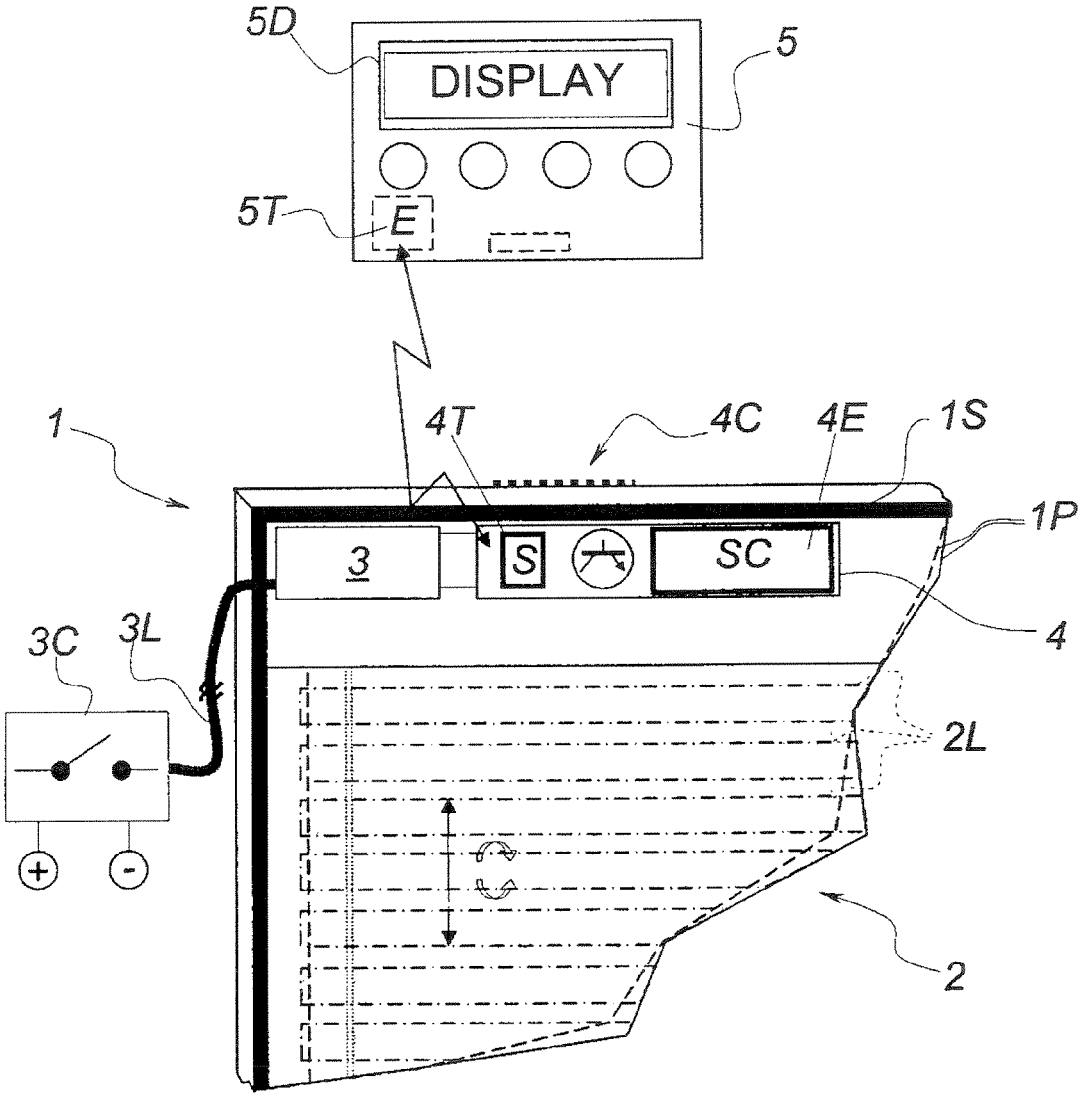
5D
DISPLAY
5
5T
E
1
4T
4C
4E
1S
1P
3
S
SC
4
3C
3L
2L
2

MULTIPLE-PANE WINDOW WITH AN ELECTRICAL BUILT-IN ELEMENT

CROSS-REFERENCE TO RELATED APPLICATIONS

The present application is a 371 of PCT/EP06/03485 filed Apr. 15, 2006 and claims the benefit of DE 10 2005 019 326.9 filed Apr. 26, 2005.

BACKGROUND OF THE INVENTION

1. Field of the Invention

The invention relates to a multilayer or insulating window pane with an electrical component, having the features of the preamble of patent claim 1. The invention especially relates to a multilayer or insulating window pane having a built-in electric motor which is provided, for example, for driving a Venetian blind or a fan.

2. Description of Related Art

Window panes or glazings of this type are known, for example, from DE 197 33 801 C2. EP 345 007 B1 also describes an insulating glazing having an internal blind which can be moved by an electric motor. In this known solution, the electric motor is inserted into a housing which is inserted into a corner region of the spacer frame. The housing is of L-shaped design overall and at each of its two ends has pins which can be inserted into the abutting hollow spaces in the spacer profiles in a sealing manner. Electrical connections for the motor are installed on the outer face, and the drive shaft of the motor is passed through on the inner face (toward the intermediate space between the panes).

Once the component is installed in an insulating window pane which is adhesively bonded and sealed in a gas- and water-vapor-tight manner, it is, in principle, no longer readily accessible for repair purposes. However, movable components, for example Venetian blinds, are tested by the manufacturer for a high number of load cycles, and the guarantee for normal operation extends to a minimum number of load cycles and/or to the guaranteed service life of the component. Use beyond this number of load cycles and/or service life naturally leads to increased wear.

However, the component could, for example, also be a pressure-compensation valve which can be electrically switched and allows the internal pressure in an insulating glazing to be periodically equalized with the external pressure.

In general, load-cycle or cycle counters are known which detect the degree of use of electrical and/or mechanical apparatuses using mechanical or electrical/electronic counters and memories, and display it for users and/or maintenance personnel to read off. By way of example, reference may be made to copy counters of commercial photocopiers or to cycle counters for charging processes of storage batteries.

Insulating window panes with built-in solar cells are also known (for example DE 199 58 879 A1).

BRIEF SUMMARY OF THE INVENTION

The invention is based on the object of providing tamperproof detection of operating data of the electrical components in an insulating window pane of the type mentioned in the introduction.

BRIEF DESCRIPTION OF THE DRAWINGS

The Figure shows a schematic and highly simplified possible exemplary embodiment of an inventive multilayer window pane with an electrical component together with a detection and reading-out device.

DETAILED DESCRIPTION OF THE INVENTION

According to the invention, this object is achieved by the features of patent claim 1. The features of the subclaims specify advantageous developments of this invention.

If the electrical connection device—or else the component itself—which is located in the sealed intermediate space between the panes of the insulating window pane comprises a detection device for operating data, which detection device is protected against intervention from the outside, it being possible to at least indirectly read off or read out said operating data, the manufacturer or supplier is provided with a way of checking the actual state of use of the component in situ. It can therefore possibly protect against unjustified claims on the guarantee.

In this context, tamperproof means that unauthorized intervention in the detection device is possible only by destroying the composite pane.

Within the scope of this description, the material of the rigid window panes themselves is of secondary importance. They may be composed of monolithic or composite glass, or else of suitable plastics.

The operating data or states mentioned here may include operating or switch-on times (run-time memory), switching cycles (load-cycle counter), maximum temperatures and/or maximum current consumption and/or maximum applied voltage (rewritable maximum-value memory/overload detection) or the like. If the component comprises photovoltaic solar cells, the power (maximum voltage, supplied power etc.) generated by the latter could be detected and evaluated. At the same time, the power generated can be used to feed the detection device, if required.

Data relating to the serial or part numbers and date of production or year of manufacture are expediently to be entered in the detection device, so that it is possible to identify the component on site on the pane itself. This may be present in coded form and also be used to individually address the detection device for the reading-off or reading-out process.

The connection device under consideration here may also be a control circuit which is provided particularly for the electric motor of a Venetian blind or a fan. It can convert switching pulses, which are supplied from the outside or else by built-in sensors (for the incidence of light, effect of heat), for activating the corresponding movement processes of the motor.

For the abovementioned case of monitoring a pressure-compensation valve which can be electrically switched, a connection device together with a control circuit is likewise optionally provided, it being possible to detect the operating data of the latter in the same way and, if required, output it in a suitable manner.

Components of this type may also be controlled centrally or by sensors, so that a manual switch-on process is not always required. Incorrect operations which initially remain unnoticed but overload the component due to an undesirably high operating time may occur specifically in the case of control of this type.

An operating-data display of the detection device which is directly visible from the outside, for example in the form of a liquid crystal display which is arranged behind one of the panes, is also feasible. Instead of continuous operation, this display could also be activated only in the event of a reading-out operation, it being possible to optionally retrieve the relevant operating data for display purposes in turn or at the same time by control from the outside.

However, indirect reading off and data output by means of a temporary data connection between a memory of the detection device and an evaluation and/or diagnosis unit is preferred within the scope of this invention.

This data connection can be produced by means of a plug connection which is provided on the outside of the insulating glazing in a manner comparable with diagnostic plug connections which are also known in other applications, for example in motor vehicles. By way of example, it is possible to use a plug connection which is provided in any case for connecting a power supply of the component, or at least a part of said plug connection, for the data connection, so as to save space. In principle, the operating data can also be output by means of the electrical connections of the component.

It is naturally advantageous if the data connection can be produced in the installed state of the insulating glazing. This avoids the glazing having to be removed from its frame or other mounting means in order to obtain the stored operating data.

Data connections without electrically conductive contacting means can advantageously be used for the purposes of the inventive solution, that is to say wire-free transmission means in general. Apart from connections based on radio or infrared waves, the detection device or its memory may, for example, be connected to a transponder which can transmit a counter reading and/or other values by means of an adapted reading unit in a contactless manner. Capacitive and inductive transmission is also possible.

Means such as this enable remote reading-off operations too. For example, it may be expedient on façade window panes to read-off or read-out operating data of electrical components from outside. This can be done from relatively close-by means of the enclosure which is often provided for cleaning the outer surfaces, without having to specially take hold of each window pane. The reading-out operation can even be carried out from the ground, depending on the range and directional characteristics of the reading-off equipment. Provision may be made for each detection device or window pane to be addressed by means of an individual identifier and for remote transmission and reading off of the operating data being enabled only when a correspondingly addressed retrieval signal is received.

Provision may also be made for the operating data to be read-out or output only to authorized persons by the external evaluation apparatus communicating with the internal detection device by means of a special code or by the operating data being transmitted in encoded form.

It goes without saying that a wire-free transmission path can be provided in addition to an electrically conductive contacting means by means of a plug connection.

The detection device may also be part of a self-diagnosis device, particularly in the case of a central control means. Said detection device could optionally output automatic error messages in order to indicate incorrect operation and/or imminent damage at an early stage. To this end, comparison data (highest permissible temperature/current consumption etc.) is to be stored either in the detection device itself or in a central control means to which the detection device can be connected and from which the operating data can optionally be periodically requested.

The manufacturer expediently functionally tests the detection device and the associated reading-out and evaluation apparatus before delivery by means of electrically conductive and/or non-electrically conductive contact. This may be integrated in an on-going production process.

Provision could also be made for specific operating data or the associated memories to be reset after each authorized reading-out process; but this is not absolutely necessary. For the purpose of the inventive security against tampering, it should not be possible to delete critical data contents without mechanical intervention in any case.

However, since the means which can be used for this purpose are presumed to be known as such or belong to the prior art, this does not need to be discussed in any more detail here.

In order to simplify the (contactless) reading-off operation, the insulating glazing is preferably provided with a marking which can be easily identified from the outside, and the reading device can be provided in the vicinity of this marking in order to achieve reliable signal transmission. This marking may be provided behind or on one of the areas of the glazing which are accessible in the installed state. In order to be particularly inconspicuous, said marking may be provided in decorative form or in the form of a manufacturer's stamp or logo, it also being possible for it to be concealed as an element of a decorative element covering a large area. If the end-face edge region of the glazing is accessible, the reading-out interface can also be laid there.

The preferably electronic detection device will preferably comprise one or more programmable microchips into which all of the functions and characteristic product data (for example dates of manufacture, type of device, maximum values for operating data) can be programmed on site at the factory. Specifically, it must comprise all means and/or program steps or in any case be connected to the latter, which are required to obtain the operating data to be considered or to be monitored. These may be, for example, counters, timers, clocks, or sensors for temperature, current or voltage. Furthermore, suitable data memories are to be provided. It goes without saying that the latter are expediently non-volatile memories which retain their data contents even if not provided with a supply voltage for a relatively long period of time. It should not be possible to overwrite memories for critical data (overload detection, run-time, load-cycle counters).

All of these components can be combined in a suitable housing in a very compact manner or else be integrated in an assembly element (motor or valve housing) which is provided anyway, in order to then be installed in the intermediate space between the panes of the multilayer window pane in a suitable manner.

If required, the detection device can be electrically fed independently of the mains by means of a photovoltaic solar element and optionally a current-storage means.

It is possible to read out the memory contents or data in a conventional manner using diagnosis interfaces in the ways already described above. In an evaluation apparatus, the stored data is optionally automatically compared with permissible values stored in said evaluation apparatus, so that impermissible deviations are immediately identified and correspondingly displayed. The evaluation apparatus or unit will generally also comprise means for recording the read-out data.

In a specific embodiment, the detection device is installed in the intermediate space between the panes of an insulating window pane close to the edge, so that it impairs the view through said pane as little as possible and is itself also visually concealed. The installation space required may, for example, be reserved in an upper casing for the electric drive of a Venetian blind.

It is also possible to provide the detection device very expediently directly in the region where electrical leads are led through, if these electrical leads are required in any case in order to feed the electrical component. An expedient housing structure for the detection device may be, for example, that known from EP 345 007 B1 which is described above and whose disclosure is incorporated here in this respect. The detection device is situated such that it is protected within the integrated space between the panes in this arrangement too.

If the window pane or the detection device installed therein comprises its own display, relevant data can be read-off directly from said display. The display can be activated by an external evaluation apparatus if required, whereas it remains switched off in the normal state and therefore does not consume any current.

Otherwise, an electrically conductive or non-electrically conductive connection has to be produced between the external evaluation apparatus and the internal detection device, and their data memories, in order to transmit the data for evaluation and/or reading-off purposes.

If a connection which exists in any case is used to read out the operating data, for example via the connection lines of the component, a suitable (coded) signal is transmitted to the detection device for the reading-out process, which signal triggers said detection device to output the stored data.

The single FIGURE shows a schematic and highly simplified possible exemplary embodiment of an inventive multilayer window pane with an electrical component together with a detection and reading-out device, this exemplary embodiment being described in detail below.

The FIGURE shows a detail of an insulating window pane 1 with a spacer frame 1S which circumscribes an intermediate space between the two rigid panes 1P which are situated one behind the other in the viewing direction here.

A Venetian blind 2 with a plurality of movable slats 2L is installed in the intermediate space between the panes. Said slats can be moved to various raised positions and setting angles by a electric-motor drive 3, which is only indicated, together with an associated connection and control unit 3C via a line 3L.

An electronic detection device 4 is also arranged within the intermediate space between the panes such that it is inaccessible from the outside, and is electrically connected to the drive 3 within the intermediate space between the panes in order to transmit and detect predetermined operating signals and/or data. This detection device 4 can also be invisible from the outside if it is arranged in a drive casing for the Venetian blind 2, for example.

Said detection device also comprises means 4T for transmitting (reading off or reading out) the stored or actual operating data which is represented here simply as a transmitter "S", in addition to memory means for operating data (load cycles, run times, switch-on times, maximum values for temperature and/or current flow and/or operating voltage of the component) and possibly characteristic product data (for identification) of the respective insulating window pane and the electrical component together with its mechanical auxiliary parts.

Furthermore, a solar cell 4E ("SC") is connected to the detection device 4 in order to cover its power requirement even if low. The solar cell 4E naturally has to be arranged at a suitable position on the insulating window pane 1 such that it is exposed to a sufficient amount of light in the installed state.

Finally, an identification marker 4C which can be identified from the outside displays, on or in the insulating window pane 1, the location of the detection device 4 if it is possible to read out the operating or characteristic data or activate the detection device, in order to display and/or transmit data, only over a small distance or else with contacts. In a deviation from the illustration, the identification marker can particularly also be arranged on a surface of the pane and therefore be visible in the installed state. Part of a plug connection on the pane can, for example, be provided in place of this identification marker 4C.

An external evaluation apparatus 5 is depicted above the insulating window pane 1, it being possible for this external evaluation apparatus to be connected (indicated here by a double-headed arrow) to the detection device 4 by means of a transmission means 5T. This connection can permit simple reading out but also dialog between the detection device 4 and the evaluation apparatus 5. The latter also comprises a display apparatus 5D ("display") which can be used to display operating data of the insulating window pane immediately after contact is made, optionally also with diagnosis of the state of the internal electrical components. Elements 4T and 5T can also be designed as or comprise transponders. In a deviation from this, a plug connection could also be provided between the detection device 4 and the evaluation device 5 approximately at the location of the identification marker 4C.

Instead of a display on or in an external evaluation apparatus, or in addition to the latter, the insulating window pane 1 can also comprise its own display which can be read off from the outside approximately at the location of the identification marker 4C or at another suitable location, it being possible to activate said display for reading-off purposes on a case-by-case basis—for example on account of the evaluation apparatus 5 approaching the window pane 1.

The invention claimed is:

1. A multilayer or insulating window pane, the window pane comprising:

at least two rigid panes and a spacer frame connected to the panes so as to form a tightly sealed intermediate space between the panes;

an electrical component housed in a casing arranged in the intermediate space between the panes, the electrical component configured to operate a mechanism of the window pane;

a detection device housed in the casing and configured to collect data including operating data of the electrical component, the detection device including a data processor configured to store the data in a memory of the detection device; and a transmitter configured to transmit the data from the memory to an external apparatus, the external apparatus configured to be external the window pane.

2. The window pane as claimed in claim 1, wherein the detection device is locally combined with the electrical component or an electrical connection device.

3. The window pane as claimed in claim 1, wherein the data collected by the detection device includes switch-on runtimes of the electrical component.

4. The window pane as claimed in claim 1, wherein the data collected by the detection device includes maximum values for temperature, current flow, operating voltage of the electrical component, a number of switch-on processes of the electrical component, or a combination thereof.

5. The window pane as claimed in claim 1, wherein the electrical component includes an electric motor housed in the casing and configured to operate venetian blinds of the window pane.

6. The window pane as claimed in claim 1, wherein the electrical component includes a pressure-compensation valve that is electrically switched to equalize an internal pressure of the tightly sealed intermediate space between the panes with an external pressure.

7. The window pane as claimed in claim 1, wherein the electrical component comprises at least one photovoltaic solar cell.

8. The window pane as claimed in claim 1, further comprising:

a display element for directly reading off the operating data arranged in the intermediate space between the panes.

9. The window pane as claimed in claim 8, wherein the display element is activated by means of an external evaluation apparatus.

10. The window pane as claimed in claim 1, wherein the external apparatus is an apparatus for reading off or reading out the operating data.

11. The window pane as claimed in claim 1, wherein the transmitter comprises a plug connection, part of said plug connection being arranged on the window pane in such a manner that it is accessible from the outside.

12. The window pane as claimed in claim 11, wherein the plug connection is at least part of a plug connection that is provided for electrically connecting the electrical component to a power supply.

13. The window pane as claimed in claim 1, wherein the transmitter includes a transmission path for transmitting the data without an electrically conductive contact, a built-in component of said transmission path being arranged in the insulating window pane itself.

14. The window pane as claimed in claim 13, wherein the data is transmitted by a transponder device, or in a capacitive, or inductive manner.

15. The window pane as claimed in claim 13, further comprising an external identification marker for the position of the built-in component of the transmission path.

16. The window pane as claimed in claim 15 wherein the external identification marker for the position of the built-in component of the transmission path is behind or on one of the pane surfaces of the glazing.

17. The window pane as claimed in claim 1, wherein the detection device is further configured to store, in the memory, characteristic product data of the electrical component or of the window pane.

18. The window pane as claimed in claim 1, further comprising a mains-independent power supply, in particular at least one photovoltaic solar cell, at least for the detection device.

19. The window pane as claimed in claim 1, further comprising:

venetian blinds positioned in the intermediate space between the panes, wherein the electrical component and the detection device are contained in the tightly sealed intermediate space between the panes so as to be inaccessible from outside the multilayer or insulating window pane.

20. The window pane as claimed in claim 1, wherein the detection device comprises a load-cycle counter for counting and storing, in the memory, a number of switch-on processes of the electrical component, such that the operating data includes the number of switch-on processes of the electrical component.

* * * * *